US010358328B2

(12) United States Patent
Eizenhöfer et al.

(10) Patent No.: US 10,358,328 B2
(45) Date of Patent: Jul. 23, 2019

(54) LIFTING MAST OF A LIFTING FRAME OF AN INDUSTRIAL TRUCK

(71) Applicant: Linde Material Handling GmbH, Aschaffenburg (DE)

(72) Inventors: Heiko Eizenhöfer, Mombris (DE); Steffen Geissler, Kahl am Main (DE); Stephen Schmidt, Bruchkoebel (DE)

(73) Assignee: Linde Material Handling GmbH, Aschaffenburg (DE)

( * ) Notice: Subject to any disclaimer, the term of this patent is extended or adjusted under 35 U.S.C. 154(b) by 366 days.

(21) Appl. No.: 15/348,573

(22) Filed: Nov. 10, 2016

(65) Prior Publication Data

US 2017/0129756 A1 May 11, 2017

(30) Foreign Application Priority Data

Nov. 11, 2015 (DE) ..... 10 2015 119 465

(51) Int. Cl.
*B66F 9/08* (2006.01)
*B66F 9/22* (2006.01)

(52) U.S. Cl.
CPC . *B66F 9/08* (2013.01); *B66F 9/22* (2013.01)

(58) Field of Classification Search
CPC ..... B66F 9/08; B66F 9/22
See application file for complete search history.

(56) References Cited

U.S. PATENT DOCUMENTS 4,531,615 A * 7/1985 Wible ..... B66F 9/08 187/227
10,112,815 B2 * 10/2018 Litwiller ..... B66F 9/08

FOREIGN PATENT DOCUMENTS

| | | | |
|---|---|---|---|
| CN | 201136760 | Y | 10/2008 |
| CN | 201670699 | U2 | 12/2010 |
| DE | 2617785 | A1 | 11/1976 |
| WO | 2014124932 | A1 | 8/2014 |

* cited by examiner

*Primary Examiner* — Diem M Tran
(74) *Attorney, Agent, or Firm* — The Webb Law Firm

(57) ABSTRACT

A lifting mast of an industrial truck includes a load handling arrangement that can be raised and lowered and two vertical rails at a lateral distance from one another that are connected to one another by at least one cross member. The cross member is X-shaped and includes a central area located between the vertical rails and braces that extend in an X-shape from the central area to the vertical rails and are fastened to the vertical rails. Between the central area and two pairs of braces that extend to one of the two vertical rails there are respective see-through openings that extend to one of the two vertical rails.

20 Claims, 6 Drawing Sheets

LIFTING MAST OF A LIFTING FRAME OF AN INDUSTRIAL TRUCK

CROSS REFERENCE TO RELATED APPLICATION

This application claims priority to German Patent Application No. DE 10 2015 119 465.1, filed Nov. 11, 2015, the disclosure of which is incorporated by reference in its entirety.

BACKGROUND OF THE INVENTION

Field of the Invention

This invention relates to a lifting mast of a lifting frame of an industrial truck, in which the lifting frame is provided with load handling means that can be raised and lowered and the lifting mast has two vertical rails at a lateral distance from one another that are connected to one another by at least one cross member.

Description of Related Art

Lifting masts of this type are used in lifting frames of industrial trucks such as counterbalanced forklift trucks. Lifting masts of the prior art can be in the form of a stationary mast of a single-section lifting frame (also called a simplex lifting frame) or a telescoping mast of a multi-section lifting frame, such as a duplex lifting frame, which includes one stationary mast and one telescoping mast, or a triplex lifting frame, which includes a stationary mast and two telescoping masts.

On lifting masts of this type, the two vertical rails located at a lateral distance from each other are generally connected to one another by means of at least two cross members. The area between the two vertical rails then forms an area in which the operator located in a driver's position of the industrial truck can see through the load mast to the load handling means that can be raised and lowered on the vertical rails of the lifting mast.

Types of lifting masts are known in which the two vertical rails located at a lateral distance from one another on the lifting mast are connected to one another by means of at least three cross members. A first cross member is in the form of a bottom cross member that is located in the bottom area of the vertical rails. An additional cross member is in the form of a top cross member that is located in the upper area of the vertical rails. At least one additional cross member is in the form of a middle cross member that is located between the bottom cross member and the top cross member in the vertical direction of the lifting mast. When the lifting mast is in the form of a telescoping mast that can be raised and lowered as a multi-section lifting frame, the middle cross member, which is also raised and lowered depending on the lift position of the telescoping mast and, therefore, at different lift heights of a load handling means of the lifting mast, interferes with the ability of the operator located in the driver's position of the industrial truck to see the load handling means.

On lifting masts of the prior art, the cross member is a solid component, for example a steel plate. However, a solid component of this type presents a major obstacle to the ability of the operator operating the industrial truck to see the load handling means.

To reduce the obstacles to the ability of the operator operating the industrial truck to see the load handling means, it is already known that see-through openings can be created in the cross member that are in the form of solid components, such as an essentially rectangular steel plate, for example, in locations that are not subjected to major loads. A lifting mast with a solid cross member that is provided with see-through openings of this type is described, for example, in WO 2014/124932 A1. Even with a cross member that is provided with see-through openings of this type, at different lifting heights of a load handling means of the lifting mast, there is still interference with the ability of the operator operating the industrial truck to see the load handling means at various lift heights because the load handling means are hidden by the cross member. The operator must therefore move his or her head and/or upper body (torso) into awkward and uncomfortable positions to be able to see around the cross member or below the cross member to get a view of the load handling means.

SUMMARY OF THE INVENTION

The object of this invention is to make available a lifting mast of the type described above which, as a result of its design, makes possible an improved view of the load handling means by an operator of the industrial truck.

This object is accomplished, according to the invention, in that the cross member is in the shape of an X, which includes a central area located between the vertical rails and extends in the shape of an X from the central area to the vertical rails. Braces are fastened to the vertical rails, wherein between the central area of each of the two braces that extends to the two vertical rails, a see-through opening is created that extends to one of the two vertical rails. An X-shaped cross member of this type results in an improvement in the ability of an operator to see through the lifting mast, because an X-shaped cross member forms a see-through opening laterally on either side of the central area that increases in height in the transverse direction of the lifting mast from the central area to the corresponding vertical rails in the vertical direction and extends in the transverse direction of the lifting mast to the vertical rails. See-through openings of this type on the X-shaped cross member that extend to the vertical rails and increase in height in the transverse direction of the lifting mast toward each of the vertical rails, result in an improved view through the cross members and give the operator located in the driver's position, and looking at the load handling means, a maximum field of vision over the load handling means, in which the view of the load handling means is only minimally interfered with by the cross member. The lifting mast according to the invention, therefore, makes it possible for the operator of the industrial truck to have a better view of the load handling means. The lifting mast according to the invention also results in improved ergonomics for the operator of the industrial truck because, on account of the improved visibility through the X-shaped cross member, the operator only needs to move his or her head and/or torso minimally to get a view of the load handling means through the cross member.

In one preferred embodiment of the invention, the cross member has a first brace that runs upward from the central area in the vertical direction to the first vertical rail and is fastened to the first vertical rail, a second brace that runs downward from the central area in the vertical direction to the first vertical rail and is fastened to the first vertical rail, a third brace that runs upward from the central area in the vertical direction to the second vertical rail and is fastened to the second vertical rail, and a fourth brace that runs downward from the central area in the vertical direction to the second vertical rail and is fastened to the second vertical rail. With four braces of this type that extend from the central area to the two vertical rails, an X-shaped cross member with two large see-through openings, each of which is located to one side of the central area, can be formed with little construction effort or expense. The braces of the X-shaped cross member that run up and down also achieve an increased height of the cross member on the outer ends of the cross braces and, therefore, in the area of the vertical rails. The increased height of the cross member on the outer ends of the cross braces results in lower component stresses in the event of bending loads, so that the weight and cross-section of the braces can be reduced, which results in a further improvement in the operator's ability to see through the lifting mast to the load handling means.

The braces are advantageously fastened separately from one another on the vertical rails by means of their own individual fastening interfaces. As a result of a separate and, therefore, individual fastening of the four braces arranged in the shape of an X, the cross member can be fastened to both vertical rails with little construction effort or expense. The cross member according to the invention is therefore open on the outer ends of the braces, and each of the two braces that define a see-through opening are not connected to each other on the outer ends.

With regard to an improved view of the load handling means through the lifting mast, there are additional advantages if, as in one development of the invention, an upper side of the braces run at least partly upward from the side of the lifting mast facing away from the load toward the side of the lifting mast facing the load, and an underside of the braces run at least partly downward from the side of the lifting mast facing away from the load to the side of the lifting mast facing the load. Consequently, a cross-section shape of the braces is achieved in which the front side of the braces facing away from the load has a lower height in the vertical direction than the back side of the braces facing the load. The cross-sectional shape of the braces is therefore also optimized in terms of visibility, because the underside of the braces, for an operator looking down, lie in the line of sight of the operator in the driver's position, and the upper side of the braces, for an operator looking up, lie in the line of sight of the operator located in the driver's position.

In one advantageous embodiment of the invention, a load carriage provided with the load handling means is provided so that it can move longitudinally on the vertical rails, and the lifting mast for raising and lowering the load carriage on the vertical rails is provided with a lifting cylinder device, wherein the lifting cylinder device is operationally connected with lifting means that are fastened with a first end to the load carriage and with a second end to the lifting mast and are reversed around the lifting cylinder device, wherein the lifting cylinder device is supported on the cross member and/or the lifting means are fastened to the cross member. The X-shaped cross member according to the invention, therefore, also performs the function of a fastening point of the lifting cylinder device and, optionally, also the function of protecting the lifting cylinder device against buckling. The cross member also performs the function of a bracket for the lifting means.

The lifting cylinder device is advantageously located between the vertical rails, in particular essentially centrally between the vertical rails. The lifting cylinder device is advantageously supported on the central area of the cross member and/or the lifting means are fastened to the central area of the cross member.

The X-shaped cross member according to the invention can be a single piece and can thus include a single component.

A one-piece cross member of this type is advantageously in the form of a forged part or a cast steel part.

Alternatively, a one-piece cross member of this type can be in the form of a preformed sheet-metal part. A cross member of this type can be manufactured from a steel plate by bending, for example pressing, or cutting, for example laser cutting or acetylene cutting.

The X-shaped cross member claimed by the invention can alternatively be realized in more than one piece and can therefore be assembled from a plurality of components.

For this purpose, the cross member is advantageously assembled from the central area and the braces, wherein the braces are fastened to the central area by welded connections or threaded connections.

With a cross member that includes a plurality of pieces, the central area can be in the form of a forged component or a cast steel component.

The four braces can each be formed by a single component that is fastened to the central area. Advantages in terms of favorable manufacturing conditions can be achieved if the first brace and the second brace are formed by a first preformed sheet metal part, and the third brace and the fourth brace are formed by a second preformed sheet-metal part, wherein the two preformed sheet-metal parts are fastened to the central area by welded connections or threaded connections. The preformed sheet metal parts can be manufactured from a steel plate by cutting, for example laser cutting or acetylene cutting.

In one advantageous embodiment of the invention, the load handling means are in the form of a load fork with two fork tips, wherein the see-through openings in the cross member allow a view by an operator located in a driver's position in the industrial truck of the tips of the load fork in the fully lowered position of the load handling means.

The lifting mast according to the invention can be in the form of a stationary mast of a simplex lifting frame.

Alternatively, the lifting mast according to the invention can be in the form of a telescoping mast of a multi-section lifting frame. The X-shaped cross member on a lifting frame in the form of a telescoping mast makes possible an improved view by an operator of the industrial truck of the load handling means at different lifting heights of the telescoping mast and thus of the load handling means.

BRIEF DESCRIPTION OF THE DRAWINGS

Additional advantages and details of the invention are explained below with reference to the exemplary embodiments illustrated in the accompanying schematic figures, in which.

DESCRIPTION OF THE DISCLOSURE

Figure 1:
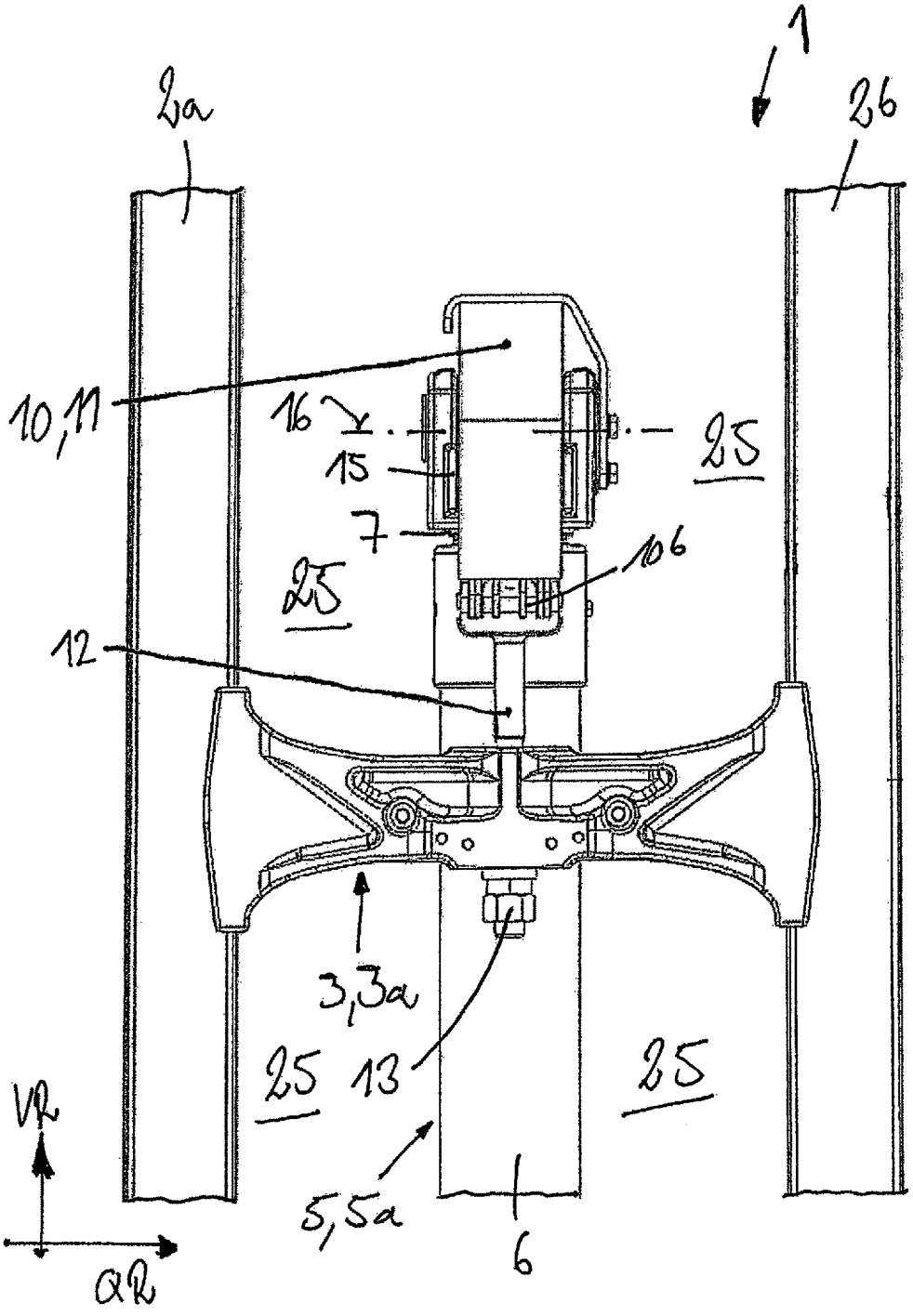
Fig. 1 (Prior Art)
FIG. 1 is a detailed view of a lifting mast of the prior art.
Figure 2:
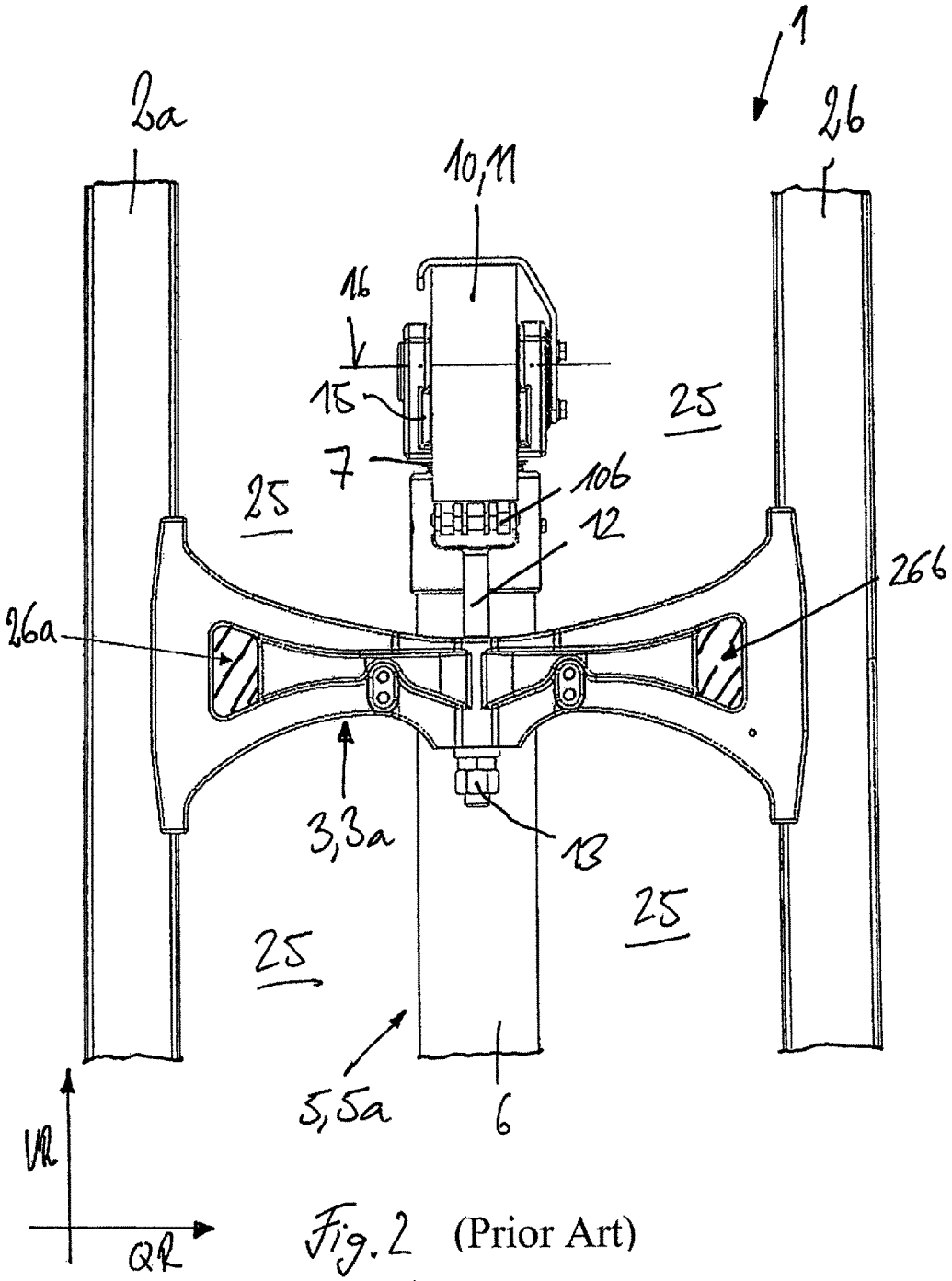
Fig. 2 (Prior Art)
FIG. 2 is a detailed view of a lifting mast of the prior art in which the cross member is provided with see-through openings.
Figure 3:
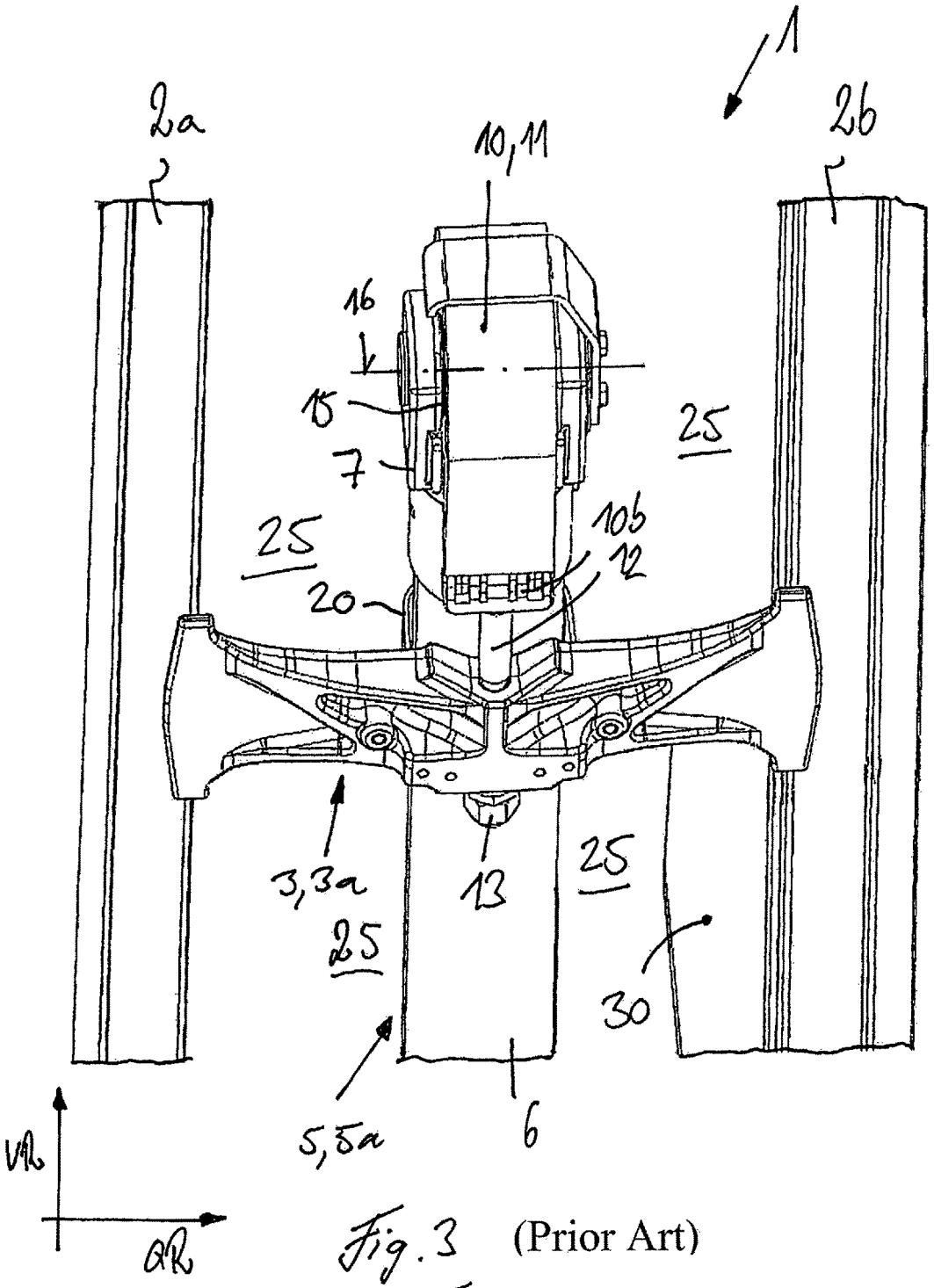
Fig. 3 (Prior Art)
FIG. 3 is a perspective view of the lifting mast from FIG. 1 with the view by an operator of the industrial truck of the fully lowered load handling means.

FIGS. 1 to 3 each show a lifting mast 1 of a lifting frame of an industrial truck of the prior art. In FIGS. 1 to 3, the lifting mast 1 is a telescoping mast, for example an inner mast of a multi-section lifting frame, for example on a duplex lifting frame or a triplex lifting frame.

The lifting mast 1 in FIGS. 1 to 3 has two vertical rails 2*a*, 2*b* at a lateral distance from one another in the transverse direction QR of the lifting mast 1. The two vertical rails 2*a*, 2*b* are connected with one another by means of a plurality of cross members 3. FIGS. 1 to 3 each show a vertical central area of the lifting mast 1. A bottom cross member, which is not illustrated in any further detail, is located in the vertically lower bottom area of the two vertical rails 2*a*, 2*b*, and is in the form of a bottom cross member. The illustrated cross member 3 is at some distance from the bottom cross member in the vertical direction VR of the lifting mast 1 and is in the form of a middle cross member 3*a*. Not shown in any further detail is a top cross member that is located in the vertically upper portion of the two vertical rails 2*a*, 2*b* and is in the form of a top cross member. The cross member 3 is preferably connected with the vertical rails 2*a*, 2*b* by welded connections.

Located on the two vertical rails 2*a*, 2*b* is a load carriage, not illustrated in any further detail, which can be displaced in the longitudinal direction, i.e. raised and lowered. The load carriage is provided with load handling means that are formed, for example, by a load fork with two fork tips.

The lifting mast 1 is provided with a lifting cylinder device 5 to raise and lower the load carriage. In the illustrated exemplary embodiment, the lifting cylinder device 5 is formed by a single lifting cylinder 5*a* that has a cylinder housing 6 that is fastened to the lifting mast 1, and a telescoping piston rod 7. The lifting cylinder 5*a* is oriented vertically upright and, in the illustrated exemplary embodiment, is located in the transverse direction QR of the lifting mast 1 between the two vertical rails 2*a*, 2*b*, preferably essentially centrally between the two vertical rails 2*a*, 2*b*. The lifting cylinder 5*a* is supported in the vertical direction with the cylinder housing 6 on the bottom cross member in a manner which is not illustrated in any further detail.

The lifting cylinder device 5 is operatively connected with lifting means 10. In the illustrated exemplary embodiment, the lifting means 10 are in the form of a lifting chain 11. The lifting means 10 are fastened with a first end in a manner not illustrated in any further detail to the load carriage. With the second end 10*b*, the lifting means 10 are fastened to the middle cross member 3*a* of the lifting mast 1. In FIGS. 1 to 3, the lifting means 10 in the form of a lifting chain 11 are provided on the second end 10*b* with a chain latch 12 that is guided through a receptacle boring in the middle cross member 3*a* and fastened by a fastening means 13, in the illustrated exemplary embodiment, a threaded connection, to the middle cross member 3*a*.

The lifting means 10 are reversed between the two ends 10*a*, 10*b* on the lifting cylinder device 5. For this purpose, the telescoping piston rod 7 of the lifting cylinder 5*a* is provided with a return pulley 15, which is mounted so that it can rotate around an axis of rotation that runs in the transverse direction QR of the lifting mast 1. The lifting means 10 are reversed by being guided around the return pulley 15.

The middle cross member 3*a* also forms an upper support for the lifting cylinder device 5. The lifting cylinder device 5 is, for this purpose, fastened to the middle cross member 3*a*, for example with a clamp 20 that surrounds the cylinder housing 6 or a cylinder head of the cylinder housing 6, as illustrated in greater detail in FIG. 3. The middle cross member 3*a* thus also performs the function of an additional fastening point of the lifting cylinder device 5 and the function of protecting the lifting cylinder device 5 against buckling.

On the lifting mast 1 illustrated in FIGS. 1 to 3, the cross member 3 in the form of a middle cross member 3*a* therefore assumes the function of an abutment for the chain latch 12 for the fastening of the lifting means 10 and as further protection of the lifting cylinder device 5 against buckling.

The lifting cylinder device 5 in FIGS. 1 to 3 is in the form of a free lift cylinder with which the load handling means in the lifting mast 1, in the form of a telescoping mast, can be raised to the maximum height before being lifted by raising the lifting mast which may be a stationary mast of a duplex lifting frame or an additional telescoping mast of a triplex lifting frame.

The area between the vertical rails 2*a*, 2*b* forms a see-through area 25 of the lifting mast 1, through which an operator located in the driver's position of the industrial truck, for example of a counterbalanced forklift truck, can see the load handling means.

In FIGS. 1 to 3, the cross member is a solid plate-shaped component which is fastened on both outer ends with the vertical rails 2*a*, 2*b* of the lifting mast 1, each by means of a welded connection. The forces exerted by the lifting means 10 on the cross member 3 are discharged via the cross member 3 and the weld seams of the welded connections into the vertical rails 2*a*, 2*b*. The shape of the cross member 3 will be determined as a function of the component stresses and the stresses in the weld seams with which the cross member 3 is welded to the vertical rails 2*a*, 2*b*, to achieve the desired durability.

FIG. 2 shows a cross member 3 in the form of a middle cross member 3*a* of a lifting mast 1 of the prior art, which is also in the form of a solid, plate-shaped component and is provided in locations which are low-loaded by the flux of force in the cross member 3 with small see-through holes 26*a*, 26*b*. The see-through holes 26*a*, 26*b* are formed by cutouts in the solid and plate-shaped cross member 3, which are indicated by the hatching in FIG. 2. The view through the cross member 3 can be improved by the see-through holes 26*a*, 26*b* in the solid and plate-shaped cross member 3.

However, one disadvantage on a lifting mast 1 of the prior art, with the cross members 3 illustrated in FIGS. 1 and 2, is that an operator located in the driver's position on the industrial truck, at different lifting heights of the lifting mast 1 and thus of the load handling means, cannot see the fork tips of the fork of a load handling means in the form of a load fork in the operator's normal posture and in the normal direction of view, because the tips of the forks are hidden by the solid and plate-shaped cross member 3.

This situation is illustrated in FIG. 3, which shows the lifting mast 1 from FIG. 1. In FIG. 3, the lifting mast 1 is shown with the load handling means in the fully lowered position. The load handling means are in the form of a load fork with two forks, of which the right fork 30 is illustrated in FIG. 3. FIG. 3 shows the field of view of an operator located in the driver's position of the industrial truck in a normal posture and in a normal direction of view of the fork 30. In this lifting position of the load handling means, the fork tip of the fork 30 is concealed by the cross member 3, so that the operator cannot see the fork tip of the fork 30 with a normal posture and in a normal direction of view. Even with a construction of the cross member 3 illustrated in FIG. 2 with see-through holes 26*a*, 26*b*, there is no significant improvement in the view of the operator of the industrial truck of the forks 30 and the fork tips. On a lifting mast 1 of the prior art, the operator must move his or her head and/or torso correspondingly awkwardly to be able to see the fork tips of the forks 30 around the cross member 3 or below the cross member 3. However, this results in poor ergonomics for the operator of the industrial truck.

However, the fork tips of the fork 30 of the load forks are an important factor for the orientation of the operator of the industrial truck.

Figure 4:
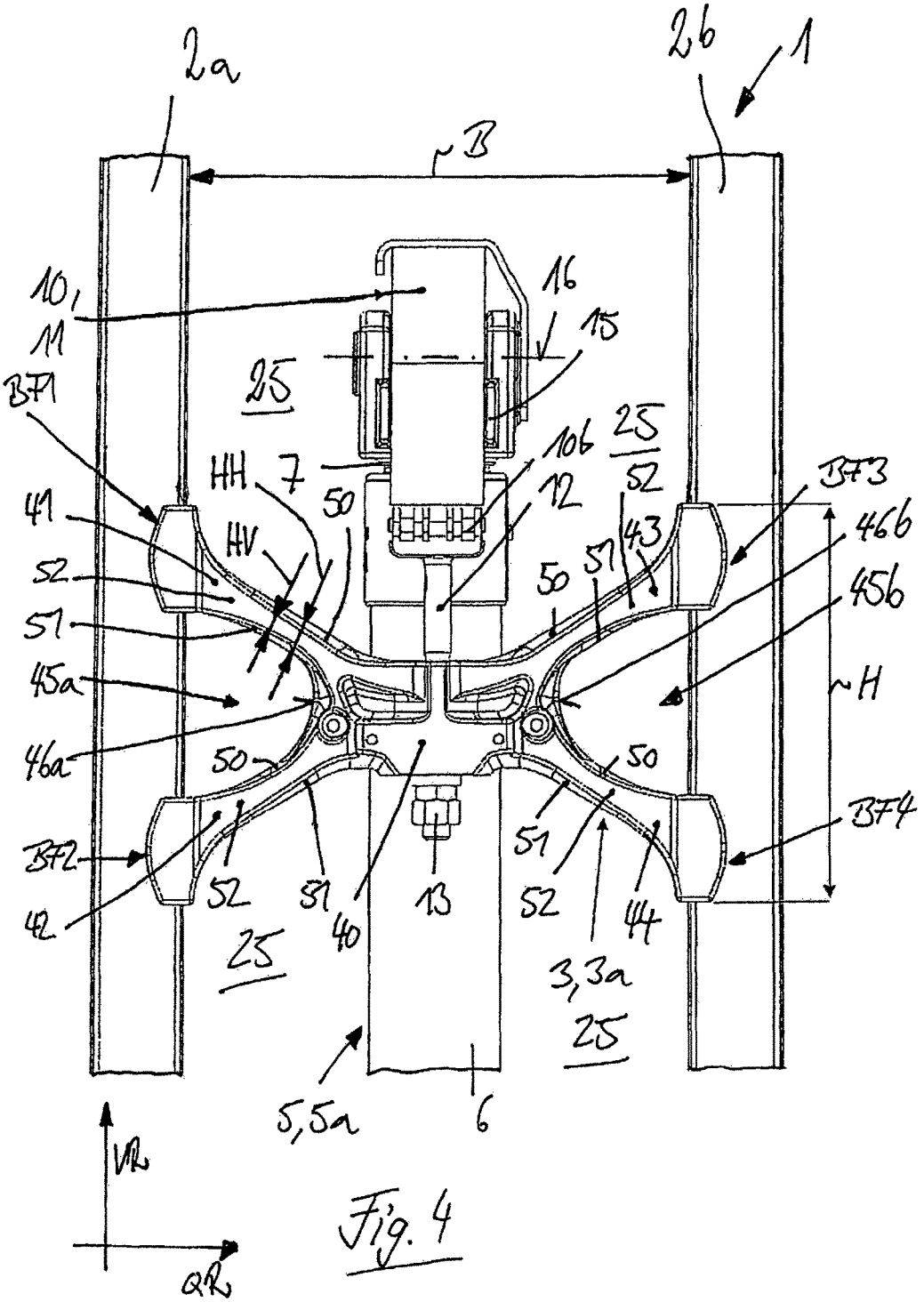
FIG. 4 is a detailed view of a lifting mast according to the invention.
Figure 5:
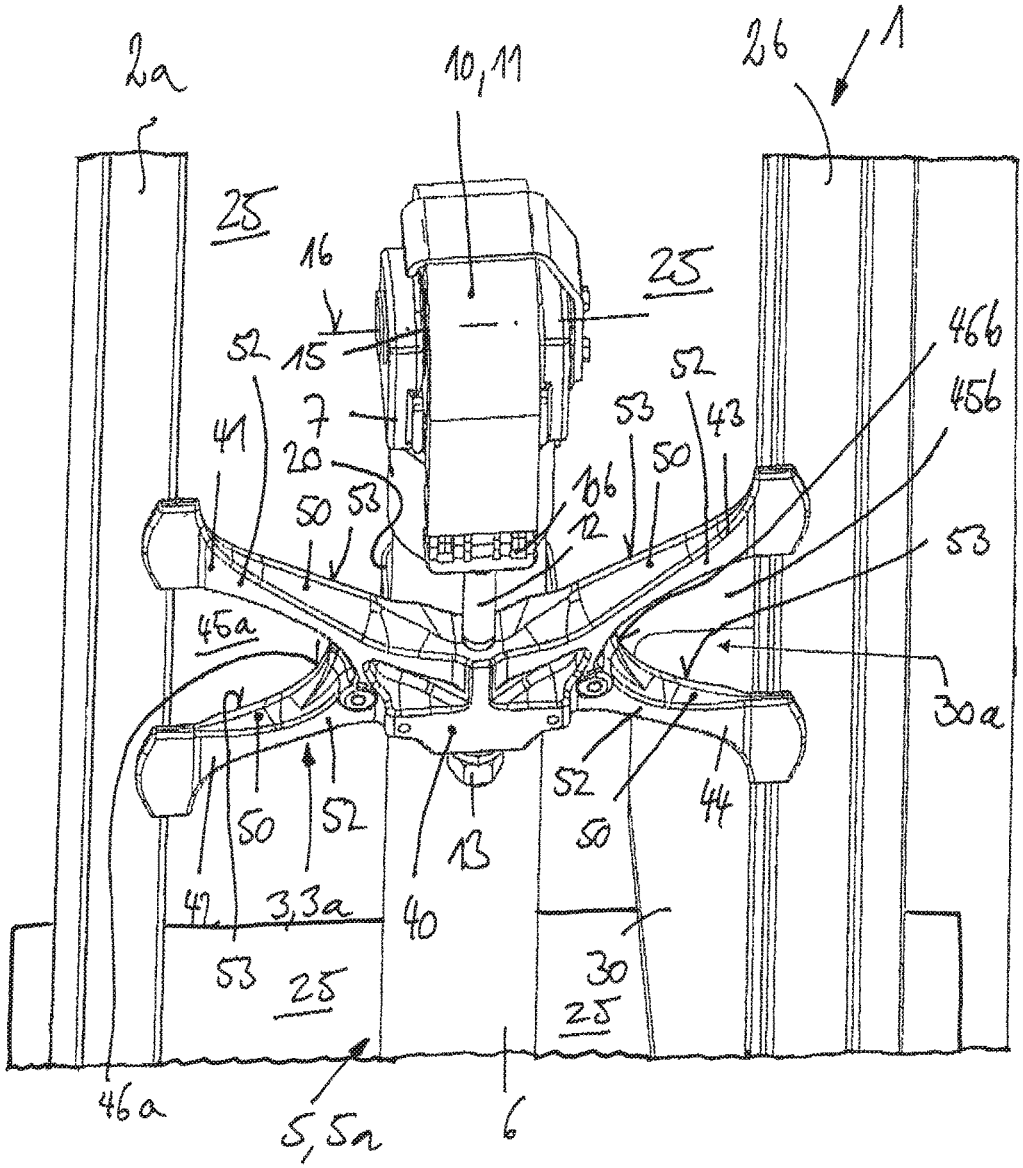
FIG. 5 is a perspective view of the lifting mast in FIG. 4 with a view by an operator of the industrial truck of the fully lowered load handling means.
Figure 6:
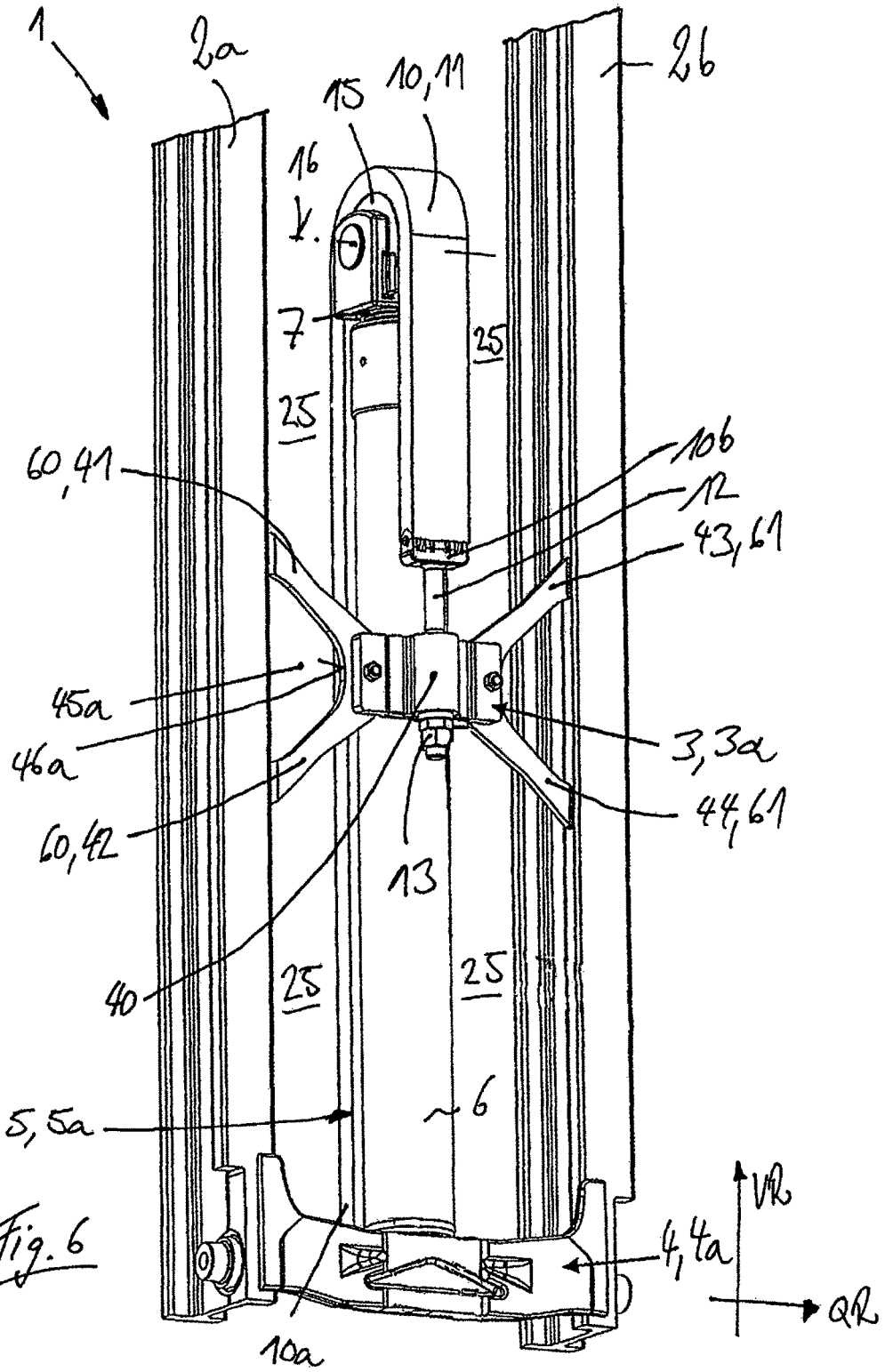
FIG. 6 is a perspective view of an alternative embodiment of a lifting mast according to the invention.

FIGS. 4 to 6 each show a lifting mast 1 of a lifting frame of an industrial truck. Components that are the same as in FIGS. 1 to 3 are identified by the same reference numbers. FIG. 4 shows a first exemplary embodiment and FIG. 6 shows a second exemplary embodiment of a lifting mast 1 according to the invention.

In FIGS. 4 to 6, the lifting mast 1 is shown, by way of example, as an inner mast of a multi-section lifting frame, for example of a duplex lifting frame or a triplex lifting frame.

The lifting mast 1 illustrated in FIGS. 4 to 6 has two vertical rails 2*a*, 2*b* that are at a lateral distance from one another in the transverse direction QR of the lifting mast 1. The two vertical rails 2*a*, 2*b* are connected with one another by means of a plurality of cross members 3. FIGS. 4 and 5 each show a vertically middle portion of a lifting mast 1 according to the invention. FIG. 6 shows a vertically middle portion and a bottom portion of a lifting mast 1 according to the invention. FIG. 6 shows the bottom cross member 4 in the vertically lower portion of the two vertical rails 2*a*, 2*b*, which is in the form of a bottom cross member 4*a*. The cross member 3 illustrated in FIGS. 4 to 6 is at a distance from the bottom cross member 4*a* in the vertical direction VR, and is in the form of a middle cross member 3*a*. Not illustrated in any further detail is a top cross member which is located in the vertically upper portion of the two vertical rails 2*a*, 2*b* and is in the form of a top cross member. The cross member 3 as well as the cross member 4 are preferably connected to the vertical rails 2*a*, 2*b* by welded connections.

Located on the two vertical rails 2*a*, 2*b* is a load carriage not illustrated in any further detail, which can be moved longitudinally, i.e. raised and lowered. The load carriage is provided with load handling means (also referred to as a load handling arrangement) that are formed, for example, by a load fork with two fork tips.

The lifting mast 1 is provided with a lifting cylinder device 5 to raise and lower the load carriage. In the illustrated exemplary embodiment, the lifting cylinder device 5 is formed by a single lifting cylinder 5*a*, which has a cylinder housing 6 that is fastened to the lifting mast 1 and a telescoping piston rod 7. The lifting cylinder 5*a* is oriented vertically upright and, in the illustrated exemplary embodiment, is located in the transverse direction QR of the lifting mast 1 between the two vertical rails 2*a*, 2*b*, preferably centrally between the two vertical rails 2*a*, 2*b*. The lifting cylinder 5*a*, as illustrated in greater detail in FIG. 6, is supported in the vertical direction with the cylinder housing 6 on the bottom cross member 4.

The lifting cylinder device 5 is operatively connected with lifting means 10 (also referred to as a lifting device). In the illustrated exemplary embodiment the lifting means 10 are a lifting chain 11. The lifting means 10 are fastened with a first end 10*a* in a manner not shown in any further detail to the load carriage. With a second end 10*b*, the lifting means 10 are fastened to the middle cross member 3*a* of the lifting mast 1. In FIGS. 4 to 6, the lifting means 10 in the form of a lifting chain 11 are provided on the second end 10*b* with a chain latch 12, which is guided through a receptacle boring in the middle cross member 3*a* and is fastened to the middle cross member 3*a* by means of fastening means 13, in the illustrated exemplary embodiment a threaded connection.

The lifting means 10 are reversed between the two ends 10*a*, 10*b* on the lifting cylinder device 5. The telescoping piston rod 7 of the lifting cylinder 5*a* is, for this purpose, provided with a return pulley 15, which is mounted so that it can rotate around an axis of rotation 16 that runs in the transverse direction QR of lifting mast 1. The lifting means 10 are reversed by being guided by means of the return pulley 15.

The middle cross member 3*a* also forms an upper support for the lifting cylinder device 5. For this purpose, the lifting cylinder device 5 is fastened to the middle cross member 3*a*, for example with a clamp 20 that surrounds the cylinder housing 6 or a cylinder head of the cylinder housing, as illustrated in further detail in FIG. 5. The middle cross member 3*a* therefore also performs the function of an additional fastening point for the lifting cylinder device 5 and the function of protecting the lifting cylinder device 5 against buckling.

On the lifting mast 1 illustrated in FIGS. 4 to 6, the cross member 3 in the form of a middle cross member 3*a* assumes the function of an abutment for the chain latch 12 for the fastening of the lifting means 10 and the lifting cylinder device 5 against buckling.

In FIGS. 4 to 6, the lifting cylinder device 5 is in the form of a free lift cylinder, with which the load handling means in the lifting mast 1, in the form of a telescoping mast, can be raised to their maximum height before the lifting mast, in the form of a telescoping mast in a stationary mast of a duplex lifting frame or an additional telescoping mast of a triplex lifting frame, is raised.

The area between the vertical rails 2*a*, 2*b* forms a see-through area 25 of the lifting mast 1, through which an operator located on a driver's position of the industrial truck, for example of a counterbalanced forklift, can see the load handling means.

On the lifting mast 1 according to the invention illustrated in FIGS. 4 to 6, the cross member 3 in the form of a middle cross member 3*a* is in the shape of an X. The cross member 3 in the shape of an X includes a central area 40 located between the vertical rails 2*a*, 2*b* and braces 41-44 extending in an X-shape from the central area 40 to the vertical rails 2*a*, 2*b* and fastened to the vertical rails 2*a*, 2*b*. Between the central area 40 and the two braces 41, 42 and 43, 44 that extend to one of the two vertical rails 2*a* and 2*b*, respectively, a see-through opening 45*a*, 45*b* is formed that extends in the transverse direction QR to the vertical rails 2*a* or 2*b*.

The cross member 3 according to the invention has a first brace 41 that runs from the central area 40 upward in the vertical direction to the first vertical rail 2*a* and is fastened to the first vertical rail 2*a*, and a second brace 42, that runs from the central area 40 downward in the vertical direction to the first vertical rail 2*a* and is fastened to the first vertical rail 2*a*. A see-through opening 45*a* is formed between the central area 40, the two braces 41, 42 and the vertical rail 2*a*. The cross member 3 according to the invention also has a third brace 43 that runs from the central area 40 upward in the vertical direction to the second vertical rail 2*b* and is fastened to the second vertical rail 2*b*, and a fourth brace 44 that runs from the central area 40 downward in the vertical direction to the second vertical rail 2*b* and is fastened to the second vertical rail 2*b*. The see-through opening 45*b* is formed between the central area 40, the two braces 43, 44 and the second vertical rail 2*b*.

The braces 41-44 extend outward from the central area 40 toward the vertical rails 2*a*, 2*b*, so that the see-through openings 45*a*, 45*b* in the central area 40 form a rounded, in particular circular, transition 46*a*, 46*b*. A transition 46*a*, 46*b* of this type has a favorable effect on the component stresses effected by the flux of force in the cross member 3.

In the laterally outer area on the vertical rails 2*a*, 2*b*, the see-through openings 45*a*, 45*b* have a vertical dimension in the vertical direction VR that is greater than the maximum vertical dimension of the central area 40 in the vertical direction VR.

The braces 41-44 are separated from one another on the outer ends on the vertical rails 2*a*, 2*b* of the lifting mast 1 by means of individual fastening interfaces BF1-BF4. The braces 41-44 are therefore each fastened separately from one another to the vertical rails 2*a*, 2*b*. Preferably, the braces 41-44 are each fastened on their outer ends with the corresponding vertical rail 2*a* or 2*b* by a welded connection with corresponding weld seams. The cross member 3 according to the invention is therefore open on the outer ends of the braces 41-44. The braces 41 and 42 have no connection to each other on the outer ends. Accordingly, the braces 43 and 44 likewise have no connection on their outer ends.

The braces 41-44 are inclined upward or declined downward, respectively, so that the cross member 3 according to the invention, in contrast to a cross member 3 of the prior art, in the outer regions in which the cross member 3 is connected with the vertical rails 2*a*, 2*b* has an exaggerated height H in the vertical direction. Preferably, the cross member 3 according to the invention has a ratio H/B of the height H to the lateral distance B between the two vertical rails 2*a*, 2*b* greater than or equal to 0.65. As a result of the increase of the height H on the outer ends of the cross member 3, two narrow braces 41, 42 and 43, 44, respectively, can be used on each side of the cross member 3 instead of a solid web of the cross member 3 of the prior art (FIGS. 1 to 3), so that correspondingly large see-through openings 45*a*, 45*b* are formed which allow an improved view through the cross member 3 according to the invention.

In the exemplary embodiment illustrated in FIGS. 4 and 5, an upper side 50 of the braces 41-44 runs upward at least partly from the side of the lifting mast 1 facing away from the load toward the side of the lifting mast 1 facing the load, and a bottom side 51 of the braces 41-44 runs at least partly downward from the side of the lifting mast 1 facing away from the load to the side of the lifting mast 1 facing the load. The braces 41-44, therefore, have at least partly, on the front side 52 of the braces 41-44 facing away from the load, a lesser height HV (thickness of the braces 41-44) in the vertical direction VR than the height HV on the back side 53 of the braces 41-44 facing the load.

On the lifting mast 1 according to the invention, the lifting cylinder device 5 is supported on the central area 40 of the cross member 3 and the lifting means 10 are fastened to the central area 40 of the cross member 3. For this purpose, the lifting cylinder device 5 is fastened to the central area 40, for example with the clamp 20 that surrounds the cylinder housing 6 or a cylinder head of the cylinder housing 6, as illustrated in greater detail in FIG. 5. The lifting means 10, in the form of a lifting chain 11, are for this purpose provided on the second end 10*b* with a chain latch 12 that is guided through a receptacle boring of the central area 40 and is fastened to the central area 40 by a fastening means 13, in the illustrated exemplary embodiment, a threaded connection.

In the exemplary embodiment illustrated in FIGS. 4 and 5, the cross member 3 according to the invention is in one piece. The cross member 3 including the central area 40 and the four braces 41-44 is preferably a forged or a cast steel component. The braces 41-44 are preferably each fastened to the vertical rails 2*a*, 2*b* of the lifting mast 1 by a welded connection.

In the exemplary embodiment illustrated in FIG. 6, which illustrates an additional exemplary embodiment of the invention, the cross member 3 is made up of a plurality of pieces. The cross member 3 illustrated in FIG. 6 is formed from one component that forms the central area 40 and additional components that, when assembled, form the braces 41-44. The components that form the braces 41-44 can thereby be fastened to the component that forms the central area 40 by welded connections or threaded connections.

The component that forms the central area 40 is preferably a forged component or a cast steel component.

In FIG. 6, the first brace 41 and the second brace 42 are formed by a first preformed sheet-metal part 60. The third brace 43 and the fourth brace 44 are formed by a second preformed sheet-metal part 61. The two preformed sheet metal parts 60, 61 are fastened to the component that forms the central area 40 by welded connections or threaded connections. The preformed sheet metal parts 60, 61 are preferably in the form of preformed sheet-metal parts that are manufactured from a steel plate by cutting, for example laser cutting or acetylene cutting.

On a lifting mast 1 according to the invention with the X-shaped cross member 3, illustrated in FIGS. 4 to 6, the see-through openings 45*a*, 45*b* result in an improved view through the lifting mast 1 for an operator located in the driver's position of the industrial truck at different lifting heights of the lifting mast 1 and thus of the load handling means. The see-through openings 45*a*, 45*b* allow the driver to see the fork tips of the load forks of the load handling means in the form of a load fork in a normal posture and with a normal direction of view because the tips of the load forks are visible through the see-through openings 45*a*, 45*b* of the cross member 3 according to the invention.

This configuration is illustrated in FIG. 5, which shows the lifting mast 1 illustrated in FIG. 4. In FIG. 5, the lifting mast 1 is shown with the load handling means in the fully lowered position. The load handling means is in the form of a load fork with two forks 30, the right fork 30 of which is illustrated in FIG. 5. In FIG. 5, the field of vision of an operator in the driver's position of the industrial truck is shown with the driver in a normal posture and with a normal direction of view toward the fork 30. In this lifting position of the load handling means, the fork tip 30*a* of the fork 30 is not concealed by the cross member 3 but is visible through a see-through opening 45*b* of the cross member 3, so that the operator can see the fork tips 30*a* of the fork 30 in a normal posture and in a normal direction of sight.

On the cross member 3 according to the invention, as a result of the optimized height H on the outer ends of the cross member 3, wherein the optimized height H results in lower bending stresses in the cross member 3 that are exerted by the forces from the fastening of the lifting means 10, the weight of four braces 41-44 and their cross-sections can be reduced so that the large see-through openings 45*a*, 45*b* in the cross member 3 are achieved. On account of its X shape, the cross member 3 according to the invention allows a maximum field of vision and an improved view of the fork tips 30*a* of the fork 30 by the operator located in the driver's position on the industrial truck. On account of the large see-through openings 45*a*, 45*b* of the cross member 3, in comparison to the prior art, the view by the operator located in the driver's position of the industrial truck through the lifting mast 1 of the fork tips 30*a* of the fork 30 of a load handling means in the form of a load fork with two forks 30 is significantly improved. The improved and optimized view of the fork tips 30*a* of the fork 30 results in an improved orientation of the operator of the industrial truck located in the driver's position of the industrial truck. The cross member 3 according to the invention also results in improved ergonomics for the operator in the driver's position of the industrial truck because, in a normal posture and with a normal direction of view, the operator can see the fork tips 30*a* so that no change in posture and/or the direction of view is necessary to get a view of the fork tips 30*a* of the load fork 30.

With the cross member 3 according to the invention, as a result of the increased and optimized height H on the outer ends of the cross member 3, reduced bending stresses and torsion stresses occur in the cross member 3 on account of the forces transmitted by the fastening of the lifting means 10 and the lifting cylinder device 5. When the cross member 3 is connected with the vertical rails 2*a*, 2*b* by welded connections, as a result of the increased and optimized height H on the outer ends of the cross member 3, lower stresses also occur in the weld seams of the welded connections, which has a favorable effect on the durability of the cross member 3.

The invention is not restricted to the exemplary embodiment illustrated in FIGS. 4 and 5 with the one-piece cross member 3 in the form of a forged component or a cast steel component. Alternatively, the one-piece cross member 3 illustrated in FIGS. 4 and 5 can be a preformed sheet-metal part and can be manufactured from a steel plate by bending, pressing, or cutting, for example laser cutting or acetylene cutting.

Nor is the invention restricted to the exemplary embodiment with a multi-part cross member 3 illustrated in FIG. 6. A multi-part cross member 3 can alternatively be in the form of a welded assembly that has a shape comparable to the one illustrated in FIG. 4 or FIG. 6.

Instead of the design of the lifting cylinder device 5 with a single lifting cylinder 5*a* and a single lifting means 10, the lifting cylinder device 5 can be formed by a plurality of lifting cylinders and a plurality of lifting means 10.

The lifting means 10, as an alternative to the use of a lifting chain 11, can also be in the form of a lifting belt or lifting cable.

The lifting mast 1 according to the invention can be in the form of a stationary mast in the form of a single-section lifting frame (simplex lifting frame) or a telescoping mast of a multi-section lifting frame, for example of a duplex lifting frame or a triplex lifting frame.

It will be readily appreciated by those skilled in the art that modifications may be made to the invention without departing from the concepts disclosed in the foregoing description. Accordingly, particular embodiments described in detail herein are illustrative only and are not limiting to the scope of the invention, which is to be given the full breadth of the appended claims and any and all equivalents thereof.

The invention claimed is:

1. A lifting mast of an industrial truck, the lifting mast comprising:

a load handling arrangement that is raised and lowered, and two vertical rails at a lateral distance from one another that are connected to one another by at least one cross member, wherein the cross member is X-shaped and includes a central area located between the vertical rails and braces that extend in an X-shape from the central area to the vertical rails and are fastened to the vertical rails, wherein between the central area and two pairs of braces that extend to one of the two vertical rails, there are respective see-through openings that extend to one of the two vertical rails, wherein, on the vertical rails, a load carriage provided with the load handling arrangement moves longitudinally and the lifting mast is provided with a lifting cylinder device to raise and lower the lifting carriage on the vertical rails, and wherein the lifting cylinder device is fastened to the cross member.

2. The lifting mast as recited in claim 1, wherein the cross member comprises:

a first brace that runs upward in a diagonal direction from the central area to the first vertical rail and is fastened to the first vertical rail, a second brace that runs downward in the diagonal direction from the central area to the first vertical rail and is fastened to the first vertical rail, a third brace that runs upward from the central area in another diagonal direction to the second vertical rail and is fastened to the second vertical rail, and a fourth brace that runs downward in another diagonal direction from the central area to the second vertical rail and is fastened to the second vertical rail.

3. The lifting mast as recited in claim 1, wherein the braces are each fastened separately from one another to the vertical rails by individual fastening interfaces.

4. The lifting mast as recited in claim 1, wherein an upper side of the braces runs at least partly upward from a first end that is positioned on a side of the lifting mast facing away from a load to a second end that is positioned at a side of the lifting mast facing the load, and an underside of the braces runs at least partly downward from the first end that is at the side of the lifting mast facing away from the load to the second end positioned at the side of the lifting mast facing the load.

5. The lifting mast as recited in claim 1, wherein the lifting cylinder device is operationally connected with a lifting device that is fastened with a first end to the load carriage and with a second end to the lifting mast and is reversed on the lifting cylinder device wherein the lifting device is fastened to the cross member.

6. The lifting mast as recited in claim 5, wherein the lifting cylinder device is located between the vertical rails, and wherein the lifting cylinder device is supported on the central area of the cross member, the lifting device is fastened to the central area of the cross member, or the lifting cylinder device is supported on the central area of the cross member and the lifting device is fastened to the central area of the cross member.

7. The lifting mast as recited in claim 1, wherein the cross member is one piece.

8. The lifting mast as recited in claim 7, wherein the cross member is a forged part or a cast steel part.

9. The lifting mast as recited in claim 7, wherein the cross member is a preformed sheet-metal part.

10. The lifting mast as recited in claim 1, wherein the cross member is a multi-piece part.

11. The lifting mast as recited in claim 10, wherein the cross member is assembled from the central area and the braces, and wherein the braces are fastened to the central area by welded connections or threaded connections.

12. The lifting mast as recited in claim 11, wherein the central area is a forged part or a cast steel part.

13. The lifting mast as recited in claim 11, wherein the first brace and the second brace are formed from a first preformed sheet-metal part and the third brace and the fourth brace are formed by a second preformed sheet-metal part, and wherein the two preformed sheet-metal parts are fastened to the central area by welded connections or threaded connections.

14. The lifting mast as recited in claim 1, wherein the load handling arrangement is in the form of a load fork with two fork tips, and wherein the see-through openings in the cross member give an operator located in a driver's position of the industrial truck a view of the tips of the load forks in the fully lowered position of the load handling arrangement.

15. The lifting mast as recited in claim 1, wherein the lifting mast is in the form of a stationary mast of a single-section lifting frame.

16. The lifting mast as recited in claim 1, wherein the lifting mast is in the form of a telescoping mast of a multi-section lifting frame.

17. A lifting mast of an industrial truck, the lifting mast comprising:

a load handling arrangement that is raised and lowered, and two vertical rails at a lateral distance from one another that are connected to one another by at least one cross member, wherein the cross member is X-shaped and includes a central area located between the vertical rails and braces that extend in an X-shape from the central area to the vertical rails and are fastened to the vertical rails, wherein between the central area and two pairs of braces that extend to one of the two vertical rails, there are respective see-through openings that extend to one of the two vertical rails, wherein the cross member is a multi-piece part, wherein the cross member is assembled from the central area and the braces, and wherein the braces are fastened to the central area by welded connections or threaded connections.

18. The lifting mast as recited in claim 17, wherein the central area is a forged part or a cast steel part.

19. The lifting mast as recited in claim 17, wherein the first brace and the second brace are formed from a first preformed sheet-metal part and the third brace and the fourth brace are formed by a second preformed sheet-metal part, and wherein the two preformed sheet-metal parts are fastened to the central area by welded connections or threaded connections.

20. A lifting mast of an industrial truck, the lifting mast comprising:

a load handling arrangement that is raised and lowered, and two vertical rails at a lateral distance from one another that are connected to one another by at least one cross member, wherein the cross member is X-shaped and includes a central area located between the vertical rails and braces that extend in an X-shape from the central area to the vertical rails and are fastened to the vertical rails, wherein between the central area and two pairs of braces that extend to one of the two vertical rails, there are respective see-through openings that extend to one of the two vertical rails, and wherein an upper side of the braces runs at least partly upward from a first end that is positioned on a side of the lifting mast facing away from a load to a second end that is positioned at a side of the lifting mast facing the load, and an underside of the braces runs at least partly downward from the first end that is at the side of the lifting mast facing away from the load to the second end positioned at the side of the lifting mast facing the load.

* * * * *